United States Patent [19]

Oglesby

[11] Patent Number: 4,766,911

[45] Date of Patent: Aug. 30, 1988

[54] METHOD FOR TRACING SMOKING ARTICLES

[75] Inventor: Robert L. Oglesby, Kernersville, N.C.

[73] Assignee: R. J. Reynolds Tobacco Company, Winston-Salem, N.C.

[21] Appl. No.: 877,047

[22] Filed: Jun. 23, 1986

[51] Int. Cl.[4] ..... A24C 5/60

[52] U.S. Cl. ..... 131/281; 131/284

[58] Field of Search ..... 131/281, 284

[56] References Cited

U.S. PATENT DOCUMENTS 4,094,324 6/1978 Bolsinger et al. .
4,110,448 8/1978 Stoss et al. .
4,121,595 10/1978 Heitmann et al. .
4,193,409 3/1980 Wahle et al. .
4,224,497 9/1980 Duley et al. .
4,224,498 9/1980 Grollimund et al. .
4,249,545 2/1981 Gretz et al. .
4,265,254 5/1981 Koch et al. .
4,281,670 8/1981 Heitmann et al. .
4,537,206 8/1985 Lorenzen et al. .
4,585,919 4/1986 Mattei et al. .

*Primary Examiner*—V. Millin

[57] ABSTRACT

Cigarettes can be coded and identified at a later time by perforating the tipping paper to provide air dilution characteristics to the cigarette. The perforation pattern employed has a unique, predetermined configuration which is recorded and used at a later time for identifying particular set of cigarettes. A different perforation pattern can be applied to different sets of cigarettes at various times, locations, etc. Thus, the manufacturer of air dilution cigarettes can trace coded cigarettes in order to improve quality control.

12 Claims, 2 Drawing Sheets

METHOD FOR TRACING SMOKING ARTICLES

BACKGROUND OF THE INVENTION

This invention relates to smoking articles such as cigarettes, and in particular to smoking articles having perforated wrapping material.

Popular smoking articles such as cigarettes have a substantially rod shaped structure and include a smokable material such as strands of tobacco surrounded by a wrapping material such as paper thereby forming a tobacco rod. It has been desirable to provide cigarettes having cylindrical filters positioned at one end thereof. Typically, filters are constructed from fibrous materials such as cellulose acetate and are attached to the tobacco rod using tipping material. Ventilation of the cigarette can be provided by perforating the tipping material and underlying wrapping material in order to provide air diluted delivery of mainstream smoke during use.

Methods for perforating smoking articles in order to provide for air dilution thereof involve mechanical perforation as disclosed in U.S. Pat. Nos. 4,110,448 to Stoss and 4,193,409 to Wahle et al; electrostatic perforation as disclosed in U.S. Pat. No. 4,094,324 to Bolsinger et al; or laser perforation as disclosed in U.S. Pat. Nos. 4,224,498 to Grollimund et al, 4,281,670 to Heitmann et al, 4,121,595 to Heitmann et al, and 4,249,545 to Gretz et al. A method for providing unique perforation patterns to a cigarette is proposed in U.S. Pat. No. 4,265,254 to Koch et al.

It would be highly desirable to provide a method whereby particular smoking articles or particular sets of smoking articles can be identified by the characteristic perforation pattern which is provided during manufacturing stages thereof.

SUMMARY OF THE INVENTION

This invention relates to a process for coding rod shaped smoking articles for subsequent identification, each of the smoking articles having a perforated region in the outer wrap thereof, the process comprising the steps in combination:

(a) providing different, predetermined, coded perforation patterns to different sets of smoking articles from within a particular brand; and (b) recording the perforation patterns which are provided to the different sets of smoking articles; whereby (c) the subsequent identification is capable of being provided by comparing the perforation pattern of a smoking article from within a set so provided with the recorded perforation patterns of the different sets.

This invention allows the manufacturer of smoking articles such as cigarettes to encode cigarettes in an efficient and effective manner. Such encoding is useful in order to allow the manufacturer to trace defective smoking articles, defective packaging, and the like. In addition, such encoding is useful in order to identify the smoking article in terms of its age, place of manufacture, machine employed in its manufacture, machine operator and/or shift of manufacture, a set of individual cigarettes, or any other desired characteristic. This invention is particularly useful in that the manufacturer can identify otherwise indistinguishable smoking articles or sets of smoking articles within a particular brand. Thus, this invention provides the manufacturer of smoking articles with a convenient means for maintaining strict quality control of its product.

DETAILED DESCRIPTION OF THE EMBODIMENTS

Figure 1:
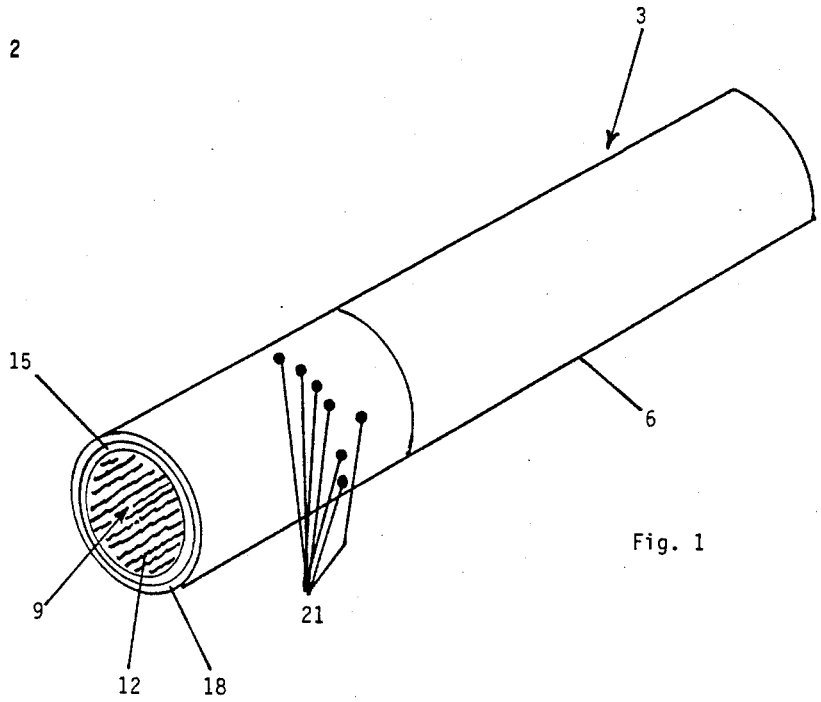
FIG. 1 is a perspective of a cigarette viewed from the mouthend thereof showing the filter region and a set of perforations having a unique and predetermined pattern in the tipping material and circumscribing the cigarette rod in a general plane substantially perpendicular to the longitudinal axis of the cigarette.

Referring to FIG. 1, smoking article 3 in the form of a cigarette includes a generally cylindrical rod 6 of smoking material contained in wrapping material (i.e., a tobacco rod). Typically, the smokable material is a charge of cured or processed tobacco, reconstituted tobacco, tobacco substitute, or blend thereof; and is provided as conventionally employed in the manufacture of cigarettes (i.e., as strands of material provided at about 32 cuts per inch and treated with flavorants and humectants). Typically, the wrapping material is a conventional cigarette wrapping paper. The size of the tobacco rod can vary, and typically ranges from about 55 mm to about 85 mm in length, and from about 20 mm to about 26 mm in circumference.

The smoking article further includes filter plug 9 positioned adjacent one end of the tobacco rod such that the filter plug is axially aligned with the rod in an end-to-end relation. Filter plug 9 has a substantially cylindrical shape, and the diameter thereof is substantially equal to the diameter of the tobacco rod. Generally, the filter plug substantially abuts the tobacco rod. The filter plug includes filter element 12 which generally is a fibrous material such as cellulose acetate; and an overwrap of circumscribing wrap 15 such as air permeable (i.e., porous) paper plug wrap or substantially air impermeable (i.e., nonporous) paper plug wrap. The length of the filter plug can vary, and typically ranges from 20 mm to 35 mm.

The filter plug is attached to the tobacco rod by tipping material 18 which circumscribes both the filter plug and an adjacent region of the tobacco rod. The inner surface of the tipping material is fixedly secured to the outer surface of the filter plug and to the wrapping material of an adjacent region of the rod. The tipping material circumscribes the rod over a longitudinal length which can vary but is typically that length sufficient to provide good attachment of the filter plug to the tobacco rod. Typically, the tipping material is a substantially air impermeable (i.e., nonporous) tipping material such as tipping paper.

The smoking article includes a plurality of substantially circumferencially spaced perforations 21 through the tipping material such that air dilution can be provided thereto. The perforations, openings or vents in the smoking article provide a certain volume of air drawn through the perforations relative to the total volume of air and smoke drawn through the smoking article and exiting the extreme mouthend thereof.

The perforations generally are positioned on the smoking article in a region from about 10 mm to about 17 mm from the extreme mouthend point thereof. The manner in which the perforations are arranged can vary depending upon factors such as the manner in which the perforations are provided, the type of air dilution characteristics desired, the pressure drop (i.e., resistance to draw) characteristics desired, the aesthetics of the perforation arrangement, the number and/or size of the perforations, and other such factors. In particular, for a particular brand the various identifying patterns most desirably are chosen such that all smoking articles within a brand have essentially the same smoking characteristics.

The process for providing the predetermined perforation pattern to the smoking article can vary, and can be any process using any apparatus which provides a perforation pattern which can be recorded and can be identified for comparison purposes. Preferably, a process is employed which is capable of providing a precisely controlled positioning of the set of individually identifiable perforations. The precisely controlled positioning of the perforations provides for a more reliable comparison of the air diluted smoking article with the recorded perforation pattern.

The predetermined perforation pattern can be provided by varying the number of perforations, the size of the perforations, the shape of the perforations, the positioning of the various perforations relative to one another, the extent to which the perforations extend around the smoking article, the number of rows of perforations which circumscribe the smoking article, and the like. For example, for many suitable applications the number of perforations range from 3 to about 220, and the size of each perforation range from about 0.005 square millimeter to about 0.1 square millimeter.

The predetermined perforation pattern can be provided and recorded by a variety of means. For example, perforations can be conveniently provided by mechanical perforation (eg., using needles, pins, teeth or other perforating or piercing elements) using an apparatus as described in U.S. Pat. No. 4,193,409 to Wahle et al, which is incorporated herein by reference for purposes of defining a suitable mechanical perforation apparatus. In particular, the perforating or piercing elements can have a predetermined positioning relative to one another. The carrier which provides a chassis or holder for the individual piercing elements of a particular configuration or positioning can be removed and replaced with another carrier with another set of piercing elements having a different configuration or positioning. The positioning of the piercing elements (i.e., which provide the characteristic perforation pattern) of the perforating unit as well as the time, location, etc., at which the particular perforating unit is installed are each recorded in order that the smoking articles perforated by the particular perforating unit can be identified at a later time.

A preferred method for providing and recording a perforation pattern involves using a source of radiation such as is provided using laser perforation process. For example, a web of convoluted paper wrap can be perforated prior to the time that the wrap is applied to the smoking article as described in U.S. Pat. No. 4,121,595 to Heitmann et al, which is incorporated herein by reference for purposes of defining a suitable radiation perforation apparatus. In particular, a laser is operated in synchronism with the drive means for moving the web along a predetermined path such that the perforations are provided at successive unit intervals along the web. The intervals along the web correspond to those regions wherein the smoking article has a perforated region when the web is ultimately subdivided and applied in discrete sections to the individual smoking articles. The laser can be controlled or modulated to provide a particular configuration or pattern when the beam therefrom impinges against the web. The particular modulation (i.e., which provides the characteristic perforation pattern) for the laser can be recorded along with the time, location, etc., at which the particular modulation is adjusted or programmed in order that the particular smoking articles provided thereby can be identified at a later time.

Another preferred method for providing and recording a perforation pattern involves using a source of radiation whereby the wrap of the smoking article is perforated after the smoking article is substantially manufactured as described in U.S. Pat. No. 4,265,254 to Koch et al, which is incorporated herein by reference for purposes of defining a suitable radiation perforation apparatus. The laser can be modulated and/or the various mirrors within the optical system can be controlled and pivoted at controlled, predetermined times in order to provide a particular perforation pattern when the laser beam impinges upon the wrap of the smoking article. Additionally, the first or last perforations made by the laser can be controlled in its shape (eg., to provide an essentially circular shape) while the other perforations are essentially tear drop shaped with the leading edge being larger than the trailing tail due to the rapid rotation of the rod shaped smoking article during the perforation process. The particular modulation (i.e., which provides the characteristic perforation pattern) for the laser can be recorded along with the time, location, etc., at which the particular modulation is adjusted or programmed in order that the particular smoking articles provided thereby can be identified at a later time.

The individual perforation patterns can be recorded by maintaining a file of wrapping material wherein the individual perforation patterns are labeled and provided therein, by reference to a file of blueprints or computer drawing files which depict the individual perforation patterns, by maintaining a computer file capable of providing a descriptive explanation of the individual perforation patterns, or other such means.

The comparison of the perforation pattern of the smoking article with the recorded perforation pattern can be accomplished by visual comparison, by visual comparison using moderate magnification means, by visual analysis using a scale such as a ruler or templet, by comparison with a recorded description of a particular coded perforation set, by a bar-code type reader interfaced to a computer, or other such means.

The manner and extent to which the smoking articles can be perforated for identification can vary. For example, the smoking articles within a particular brand can be traced by time or place of manufacture, by composition (i.e., blend) of the smokable material, by composition of materials (i.e., filter material or wrapping material) from which the smoking article is manufactured, by machine operator, or shift, or other such characteristics or factors. In particular, the encoded pattern is periodically changed as required in order to provide the desired various identifiable sets of smoking articles.

The following examples are provided to further illustrate the process of this invention but should not be construed as limiting the scope thereof.

EXAMPLE 1

Figure 2:
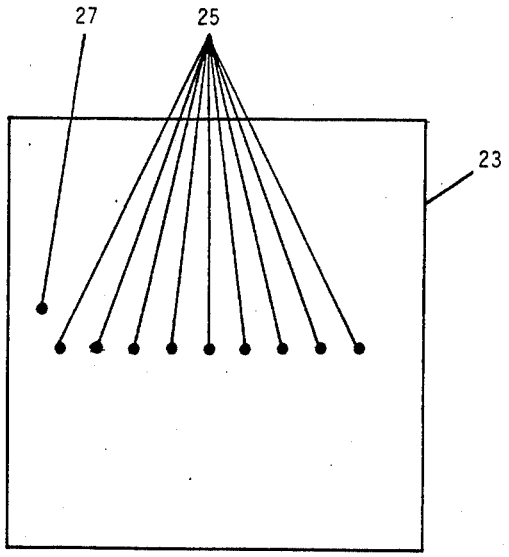
FIG. 2 is a diagrammatic illustration of a templet useful in coding smoking articles showing a predetermined perforation pattern therein.

Templet 23 shown in FIG. 2 is provided from transparent, semi-rigid polyvinylacetate film and is of a size so as to allow it to be wrapped around the filter end of a cigarette. Templet 23 shown in FIG. 2 is labeled and contains a series of perforations 25 equally spaced in a straight line across the templet. An endmost perforation 27 is positioned out of line with the other perforations. The templet contains a total of 10 perforations.

Figure 3:
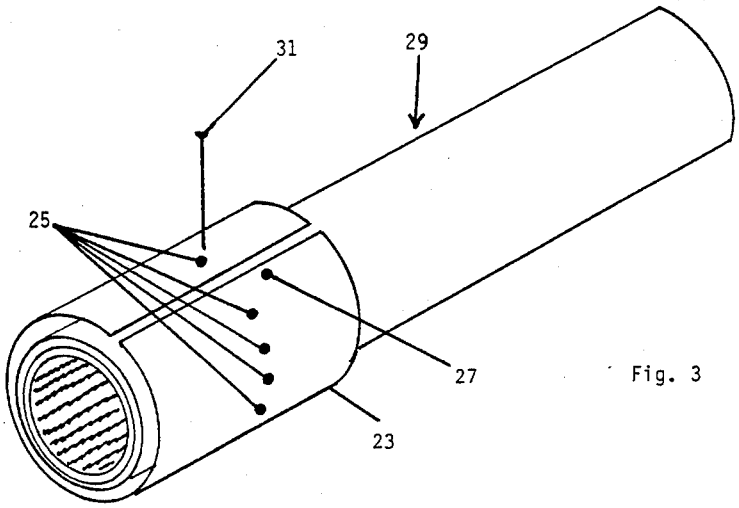
FIG. 3 is a perspective of a cigarette viewed from the mouthend thereof and showing a templet of FIG. 2 wrapped around the filter end of the cigarette such that the perforating means can provide a perforation pattern to the cigarette which matches that of the templet.

As shown in FIG. 3, the templet is wrapped around the filter end of cigarette 29 and a perforating means such as pin 31 in order to provide a cigarette having perforated tipping paper in a region which corresponds to the perforations in the templet. The perforations are of a size so as to be visible to the naked eye while providing air dilution capabilities to the perforations extend in a line generally perpendicular to the longitudinal axis of the cigarette which extends generally around the periphery of the cigarette. The cigarette can be identified at a later time by comparing the perforation paper thereon to the perforation outline provided by the templet. For ease of comparison with the templet, the tipping material can be removed from the cigarette and flattened out on a flat surface.

EXAMPLE 2

Figure 4:
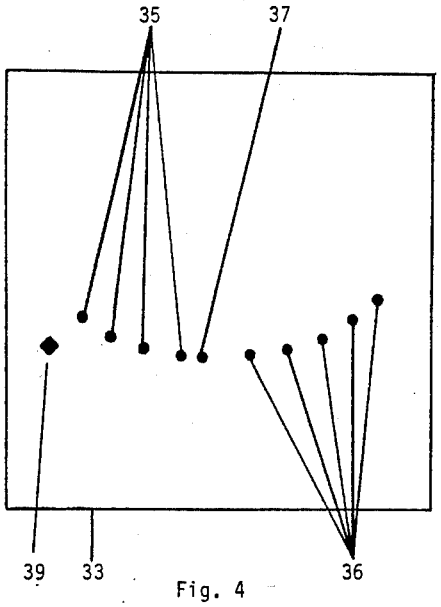
FIGS. 4 and 5 are diagrammatic illustrations of templets using in coding smoking articles showing the unique, predetermined perforation pattern of each.

Templet 33 shown in FIG. 4 is provided from transparent, semi-rigid polyvinylacetate film and is of a size so as to allow it to be wrapped around the filter end of a cigarette. Templet 33 shown in FIG. 4 is labeled and contains two sets of equally spaced perforations 35 and 36 positioned in a line across the templet. One perforation 37 is positioned closer to the first set of perforations 35 than to the second set of perforations 36. An endmost perforation 39 is positioned out of line with the other perforations and is of a size and shape different from the other perforations. In addition, the perforations form a line having a general "U" shape across the width of the templet. Such a configuration of perforations provides a perforation pattern circumferentially around the cigarette which forms a general plane an a nonperpendicular to the longitudinal axis of the cigarette. The templet contains a total of 11 perforations.

The templet is wrapped around the filter end of a cigarette as described in Example 1 and perforated in order to provide a cigarette having a perforation pattern which corresponds to the templet.

Sets of cigarettes coded with perforations using Templet No. 1 in Example 1 can be distinguished from sets of cigarettes coded using Templet No. 2 in this Example.

EXAMPLE 3

Figure 5:
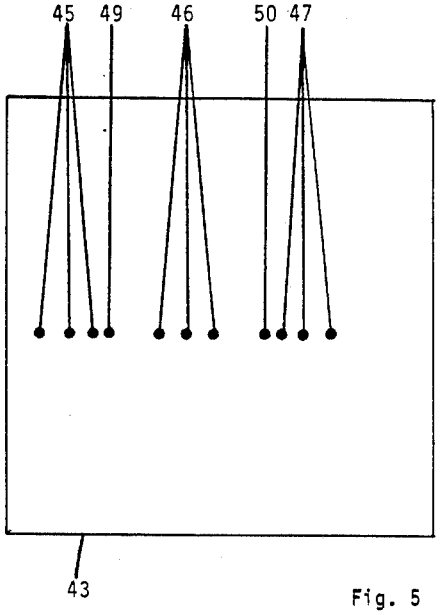

Templet 43 shown in FIG. 5 is provided from transparent, flexible, semi-rigid polyvinylacetate film and is of a size so as to allow it to be wrapped around the filter end of a cigarette. Templet 43 shown in FIG. 5 is labeled and has a series of 11 perforations positioned in a straight line across a portion of the width of the templet and contains three sets of equally spaced perforations 45, 46 and 47. One perforation 49 is positioned closer to the first set of perforations 45 than to the second set of perforations 46; and another perforation 50 is positioned closer to the third set of perforations 47 than to the second set of perforations 46.

The templet is wrapped around the filter end of a cigarette as described in Example 1 and perforated in order to provide a cigarette having a perforation pattern extending in a line partially around the filter element. The perforation pattern corresponds to the pattern of the templet and the unique pattern (i.e., which is provided by the spacing of the perforations and the extent to which the line of perforations extend circumferentially around the cigarette) can be used to identify the cigarette or cigarettes perforated with Templet No. 3.

What is claimed is:

1. A process for coding rod shaped smoking articles for subsequent identification, each coded smoking article having a perforated region in the outer wrap thereof, the process comprising the steps of:

(a) providing different, predetermined, coded perforation patterns to different sets of smoking articles from within a particular brand; and (b) recording the perforation patterns which are provided to the different sets of smoking articles; whereby the subsequent identification is capable of being provided by comparing the perforation pattern of a smoking article from within a set so provided with the recorded perforation patterns of the different sets.

2. The process of claim 1 whereby said predetermined perforation pattern is provided to a smoking article in the form of a cigarette.

3. The process of claim 2 whereby said perforated region which is provided to the outer wrap is provided to tipping material.

4. The process of claim 1 whereby said perforation is provided by mechanical perforation means.

5. The process of claim 1 whereby said perforation is provided by a source of radiation.

6. The process of claim 5 whereby the source of radiation is a laser.

7. The process of claim 1 whereby the number of perforations so provided range from 3 to about 220, and the size of each perforation is from about 0.005 $mm^2$ to about 0.1 $mm^2$.

8. The process of claim 1 whereby the predetermined perforation pattern is provided by:

(a) providing a reference perforation, and (b) spacing the distance between various other perforations about the circumference of the smoking article.

9. The process of claim 1 whereby the predetermined perforation pattern is provided according to the time and place of manufacture of the smoking article.

10. The process of claim 1 whereby the smoking articles which are coded are otherwise indistinguishable.

11. A method for identifying rod shaped smoking articles which (i) each have a perforated region in the outer wrap thereof, and (ii) can be identified as being from a set of smoking articles, the method comprising:

(a) providing different, predetermined, coded perforation patterns to different sets of smoking articles from within a particular brand; and (b) recording the perforation patterns which are provided to the different sets of smoking articles; and (c) performing subsequent identification of a particular smoking article by comparing the perforation pattern of the particular smoking article with the recorded perforation patterns.

12. A method for providing identifiable sets of rod shaped smoking articles, each of the smoking articles having a perforated region in the outer wrap thereof such that a smoking article can be identified by comparing the recorded perforation pattern of a particular smoking article with recorded perforation patterns of different sets of smoking articles, the method comprising:

(a) providing different, predetermined, coded perforation patterns to different sets of smoking articles from within a particular brand; and (b) recording the perforation patterns which are provided to the different sets of smoking articles.

* * * * *